US011076677B2

(12) United States Patent
Hervet et al.

(10) Patent No.: US 11,076,677 B2
(45) Date of Patent: Aug. 3, 2021

(54) APPLICATOR MEMBER FOR COSMETIC PRODUCT APPLICATOR, SAID APPLICATOR MEMBER BEING OBTAINED AT LEAST PARTIALLY BY MOULDING AT LEAST ONE THERMOPLASTIC ELASTOMER MATERIAL

(71) Applicant: L'OREAL, Paris (FR)

(72) Inventors: Jean-Marie Hervet, Clichy (FR); Carine Pascal, Aulnay-sous-Bois (FR); Alain Berhault, Clichy (FR); Jean-Marie Julien, Clichy (FR)

(73) Assignee: L'OREAL, Paris (FR)

( * ) Notice: Subject to any disclaimer, the term of this patent is extended or adjusted under 35 U.S.C. 154(b) by 266 days.

(21) Appl. No.: 16/067,642

(22) PCT Filed: Dec. 20, 2016

(86) PCT No.: PCT/EP2016/081872
§ 371 (c)(1),
(2) Date: Jul. 2, 2018

(87) PCT Pub. No.: WO2017/118568
PCT Pub. Date: Jul. 13, 2017

(65) Prior Publication Data

US 2019/0008262 A1 Jan. 10, 2019

(30) Foreign Application Priority Data

Jan. 5, 2016 (FR) ..... 1650038

(51) Int. Cl.
*A45D 34/04* (2006.01)
*A46B 3/00* (2006.01)
(Continued)

(52) U.S. Cl.
CPC ..... *A45D 34/045* (2013.01); *A45D 34/043* (2013.01); *A46B 3/005* (2013.01);
(Continued)

(58) Field of Classification Search
CPC ..... A45D 40/262; A45D 9/021; A45D 2/48; A45D 2200/1072; B29K 2101/12;
(Continued)

(56) References Cited

U.S. PATENT DOCUMENTS 6,984,688 B2 1/2006 Gu
2013/0089723 A1 4/2013 Jendoubi et al.
(Continued)

FOREIGN PATENT DOCUMENTS

CA 2 917 340 A1 1/2015
CN 104987646 A 10/2015
(Continued)

OTHER PUBLICATIONS

International Search Report dated Apr. 3, 2017 in PCT/EP2016/081872, 4 pages.
(Continued)

*Primary Examiner* — Camie S Thompson
(74) *Attorney, Agent, or Firm* — Oblon, McClelland, Maier & Neustadt, L.L.P.

(57) ABSTRACT

The present invention relates to an applicator member (8) for a cosmetic product applicator, in particular for applying cosmetic product to keratin fibres, and especially for applying mascara to eyelashes, said applicator member being obtained at least partially by moulding at least one thermoplastic elastomer material, characterized in that said material is a TPS having a tensile strength greater than or equal to 10 MPa, preferably greater than or equal to 15 MPa.

19 Claims, 2 Drawing Sheets

(51) Int. Cl.
*A46B 9/00* (2006.01)
*A46B 5/00* (2006.01)

(52) U.S. Cl.
CPC ..... *A46B 5/00* (2013.01); *A46B 9/005* (2013.01); *A46B 2200/1053* (2013.01)

(58) Field of Classification Search
CPC ..... B29K 2025/06; B29L 2031/42; B29L 2031/718; A46B 2200/1053; A46B 3/005; A46B 5/00; A46B 9/005; A46B 9/021; A46B 2200/106; A46B 2200/1046; A46B 1/00; B32B 27/20; A61Q 1/10; A61K 2800/10; A61K 2800/87; C08L 25/06; C08L 23/0815; C08L 53/00; C08L 53/02; C08L 23/04
USPC ..... 15/160, 106, 110, 159.1; 428/292.1; 401/129, 126; 132/218, 216, 320, 230; 300/21; 206/581; 525/240
See application file for complete search history.

(56) References Cited

U.S. PATENT DOCUMENTS

2013/0145624 A1* 6/2013 Jessemey ..... B26B 21/446 30/41
2015/0020332 A1† 1/2015 Jacob
2015/0024080 A1 1/2015 Jacob et al.
2015/0247262 A1 9/2015 Tallury et al.

FOREIGN PATENT DOCUMENTS

EP 1 407 715 A1 4/2004
JP 2002-67568 A 3/2002
JP 2003-191379 A 7/2003
JP 2008-12328 A 1/2008
JP 2012-75723 A 4/2012
JP 2013-535536 A 9/2013
JP 2014-180510 A 9/2014
JP 2014-522686 A 9/2014
WO WO 2013/003442 A2 1/2013
WO WO 2014/055946 A1 4/2014
WO WO 2014/174423 A1 10/2014
WO 2015/040208 † 3/2015

OTHER PUBLICATIONS

"A New Generation of Elastic Nonwovens Solid Durability" Kraton, Retrieved from the Internet: URL:http://www.kraton.com/products/nonwovens/elastic_nonwovens_brochure.pdf, XP055302198, Jan. 2, 2014, 6 pages.
Kraiburg TPE, FC/HE/tl Series Thermolast K, Jun. 27, 2014, https://pdb.kraiburg-tpe.com/?url=&ls=en&r=1&sid=38.†

* cited by examiner
† cited by third party

| | |
|---|---|
| TM9HET |  |
| HTF8848 |  |
| TF9AAB |  |
| TOFI 90 Sh A |  |
| Hytrel 51Sh D |  |
| TF9AAE |  |

APPLICATOR MEMBER FOR COSMETIC PRODUCT APPLICATOR, SAID APPLICATOR MEMBER BEING OBTAINED AT LEAST PARTIALLY BY MOULDING AT LEAST ONE THERMOPLASTIC ELASTOMER MATERIAL

The present invention relates to an applicator member for a cosmetic product applicator, said applicator member being obtained at least partially by moulding at least one thermoplastic elastomer material.

The expression "cosmetic products" is understood to mean any product as defined in Regulation (EC) No 1223/2009 of the European Parliament and Council of 30 Nov. 2009 relating to cosmetic products.

The present invention relates more particularly to an applicator member for applying cosmetic product to keratin fibres, in particular for applying mascara to eyelashes.

As examples of other moulded applicator members, mention may also be made of applicators for lip products (gloss, for example), that may optionally have a flocked application surface.

Generally, such an applicator member comprises a core optionally bearing a set of application elements projecting out from said core, preferably in a general direction substantially normal to the core (in particular a radial direction).

Applicator members are known in which the core and/or the application elements are obtained by moulding one or more thermoplastic elastomer (TPE) materials.

"Thermoplastic elastomer materials" is generally understood to mean polymers or a blend of polymers that have, at the service temperature, properties similar to those of vulcanized rubber. These properties disappear at the processing temperature, making subsequent processing possible, but reappear when the material returns to the service temperature (cf. standard ISO 18064:2014).

For general information on thermoplastic elastomer materials, reference may in particular be made to the guide from *Techniques de l'Ingénieur. Taité Plastiques et Composites* [*Treatise on Plastics and Composites*], AM 3 400 by Michel Biron published on 10 Jul. 2000.

Document FR 2 890 838 thus describes a mascara brush, the core and the application elements of which are obtained in a single operation of injecting/moulding a plastic material, preferably an elastomer or a polymer of the polytetrafluorethylene (PTFE) kind.

Document FR 2 902 984 describes a brush, the application elements and/or the core of which are also produced by moulding a thermoplastic material. The thermoplastic material used may be, for example, SEBS (styrene-ethylene/butylene-styrene), a silicone, butyl rubber, EPDM (Ethylene Propylene Diene Monomer), a nitrile rubber, a thermoplastic elastomer (TPE), a polyester elastomer, a polyamide elastomer, a polyethylene elastomer or a vinyl elastomer, but also a polyolefin such as polyethylene (PE) or polypropylene (PP), PVC, PS, PET, POM, PA or PMMA.

It is possible in particular to use the materials known commercially under the trade names Hytrel®, Cariflex®, Santoprene® or Pebax®, this list not being limiting.

Additionally, mention may also be made of documents FR 2 910 255, FR 2 874 798, and FR 3 012 303 which describe applicator members obtained at least partially by moulding a thermoplastic material.

Document US 2015/0020332 also mentions several materials that may be used in the manufacture of moulded applicators. This document mentions in particular silicone elastomers, thermoplastic elastomers (TPEs) such as, for example, SEBS, vinyl elastomers (EVAs), thermoplastic polyester elastomers (e.g. Hytrel® sold by Dupont de Nemours), thermoplastic polyurethane elastomers (e.g. Pellethane® sold by Dow Plastic), nitrite rubber and EPDM.

Document US 20.15/0020332 specifies that the hardness of the chosen material is preferably between 35 MPa (e.g. 35 Shore D Hytrel® from Dupont de Nemours) and 1180 MPa (e.g. 82 Shore D Hytrel®). Preferentially, the hardness of the chosen material is between 95 MPa (45 Shore D Hytrel®) and 570 MPa (72 Shore D Hytrel®). More preferentially still, the hardness of the chosen material is between 200 MPa (55 Shore D Hytrel®) and 280 MPa (63 Shore D Hytrel®).

Additionally, mention may also be made of document WO 2010/135052.

As emerges from numerous documents, Hytrel® is generally the preferred material for the manufacture of moulded applicators. A great majority of moulded cosmetic applicators are thus produced from Hytrel®.

For cosmetic applications, Hytrel® indeed has numerous advantages in terms of makeup effect.

In particular, Hytrel® gives the applicator member and/or the application elements a certain responsiveness or rebound effect when said applicator member is subjected to a makeup load. Such an effect may in particular be partly objectified by tests of compression, for example of applied force for a given compression ratio (for example 30% compression in terms of thickness).

This material has thus become a reference in the field.

In particular, many mascara brushes are made from Hytrel® 51 Shore D. Also known are mascara brushes made of Hytrel® 55 Shore D and 63 Shore D, and also brushes made by mixing Hytrel® grades of different hardnesses (e.g. 50% by weight of Hytrel® 47 Shore D and 50% by weight of Hytrel® 55 Shore D).

From the chemical point of view, Hytrel® is an ether-ester copolymer (COPE) belonging to the family of thermoplastic elastomer materials (TPEs).

More specifically, Hytrel® is a block copolymer comprising hard (crystalline or semi-crystalline) segments of polybutylene terephthalate and soft (amorphous) segments of polyesters based on long-chain glycols.

The properties of Hytrel®, including the hardness which is often used fir naming the grades, vary greatly as a function in particular of the ratio between the hard segments and soft segments, and of the chemical composition of these segments.

This is also indicated in the brochure 2013 L-14689-00 *All in One Extrusion Processing Manual* edited by Dupont, manufacturer of Hytrel®.

Despite its undeniable advantages for the manufacture of cosmetic applicators, Hytrel® also has certain drawbacks.

Firstly, Hytrel®, and COPEs in general, have a relatively high cost.

Furthermore, the Hytrel materials generally used are not of food grade (FG) according to EC regulation 1935/2004.

Next, Hytrel® and COPES have a relatively high water absorption. Thus, COPES may absorb up to 4% or even up to 7% by weight of water.

This absorbent nature has a significant impact on the manufacturing process since the Hytrel® must be dried before extrusion and must be stored in a dry place (cf. aforementioned Dupont brochure).

This highly absorbent nature may also have a sizeable impact on the formulation of the cosmetic product associated with the applicator since it risks bringing about the selective absorption of compounds of the cosmetic formula.

Specifically, many cosmetic products contain water and simultaneously comprise components and/or additives that are soluble and insoluble in said aqueous phase. An excessively high absorption of the aqueous phase of the cosmetic product may thus lead to an imbalance of the cosmetic formula and a modification of the initial formula. This involves, beforehand, formulation constraints that it is desirable to avoid. This also has an impact in terms of cost since it may then be necessary to add an excess amount of certain phases or certain compounds.

Furthermore, the lower the hardness of the Hytrel®, the greater the water absorption.

The manufacturers of cosmetic applicators have thus been made to research alternatives to this material and to use other materials for the production of cosmetic applicators.

Thus, known among the materials already cited above generally and with no particular distinction are commercially available applicators of the mascara brush type that have been made from the following materials: polypropylene block copolymer, polypropylene blend, COPE, Adflex® polyolefin, PEBA (sold in particular under the reference Pebax).

However, the performances in terms of makeup effect are rarely satisfactory, their use resulting rather from a compromise with other performances.

More particularly, the applicant has already marketed moulded mascara brushes and cosmetic applicators made from SEBS.

From the chemical point of view, SEBS is a block copolymer belonging, with SBS (styrene-butadiene-styrene), to the family of thermoplastic styrene elastomers (TPSs or TPE-Ss).

More specifically, SBSs and SEBSs comprise hard polystyrene segments and soft polybutadiene or poly(ethylene/butylene) segments.

In the same way as for Hytrel®, their properties depend in particular on the ratio between the hard segments and the soft segments, and on the chemical composition of these segments (cf. the aforementioned *Techniques de l'Ingénieur*).

TPSs have a relatively low cost and are generally more economical than Hytrel®. Furthermore, they have a limited water or moisture absorption, far lower than that of Hytrel®.

Thus, SEBSs and more generally TPSs constitute an answer to the problems of cost and absorption presented by Hytrel®.

Moreover, in order to further increase their economic advantage, it is common to add fillers to TPSs. The higher the filler content, the lower the overall cost of the material.

For this purpose, it is common to use inert mineral fillers, of $CaCO_3$ type, for example.

Unlike Hytrel®, the hardness of which is evaluated on the Shore D scale, more particularly intended for hard materials, the hardness of TPSs is evaluated normally on the Shore A scale (DIN ISO 1183-1), more particularly intended for soft materials. In the case of SEBSs, they are available in particular in food grade for Shore A hardnesses between 25 and 90. There are also several commercial non-food grade SEBSs that have a particularly high hardness, exceeding 120 or even 140 Shore A equivalents (i.e. between 70 and 90 Shore D approximately). Each TPS supplier generally has thousands of commercial references available and may where appropriate modify them on demand.

It is generally considered, in the cosmetic field, that the hardness of the material is an important feature that has a very great influence on the makeup or cosmetic properties of an applicator, in particular on the flexibility of the applicator member and the sensation effect for the consumer.

Document WO 2012/166777, which describes a moulded applicator of variable stiffness, explains that the flexibility of an applicator depends on, the type of material used, on the weight, on shape factors and on the hardness (durometer) of said material.

Document WO 2012/166777 specifies that the hardness of the material has an effect on the application characteristics of the cosmetic product or on the effectiveness of a specific application method, as is known from document U.S. Pat. No. 6,481,445 for mascara brushes with a twisted metal core.

Document U.S. Pat. No. 5,123,431 itself explains that in order to produce a cosmetic applicator having great softness and great flexibility, it is advisable to choose a material having a hardness between 6 and 40 Shore A.

These documents also explain that for the same material hardness, the flexibility of the application elements essentially results from the shape.

Furthermore, it is also considered (cf. the aforementioned *Techniques de l'Ingénieur*) that for a series of homologous grades, the elastic nature decreases when the hardness increases.

In order to try to get closer to the performances of Hytrel® for mascara brushes, the applicant has thus chosen to use an SEBS material having an almost maximum Shore A hardness, namely 90 Shore A.

On the Shore D measurement scale, a hardness of 90 Shore A corresponds substantially to a hardness of around 35 to 40 Shore D.

For applicators of lip applicator type, for example, a softer material could be chosen, and in particular an SEBS material bordering on 70 Shore A.

Despite this selection of a TPS based on its hardness, it has been observed that the performances, in terms of makeup effect, for the same shape struggled to reach those of applicator members made from Hytrel®.

In particular, the application elements of applicator members currently made of SEBS (TOFI 923 90 Sh A), although they have a lower Shore hardness than that of the Hytrel® customarily used, prove to have an insufficient elasticity and are in reality softer to the touch.

Despite the economic advantages of TPSs, this has greatly limited their use and Hytrel® remains the preferred material.

In particular, it is not currently possible to directly substitute another thermoplastic elastomer material for Hytrel® without modifying the shape characteristics of the applicator, and in particular of the application elements.

Thus, there is a need for an economical material, having a low level of water absorption, while having performances, in terms of makeup effect, for the same shape that are similar to those of Hytrel®

In order to do this, the present invention relates to an applicator member for a cosmetic product applicator, in particular for applying cosmetic product to keratin fibres, and especially for applying mascara to eyelashes, said applicator member being obtained at least partially by moulding at least one thermoplastic elastomer material, characterized in that said material is a TPS having a tensile strength greater than or equal to 10 MPa, preferably greater than or equal to 15 MPa.

The tensile strength (or ultimate tensile strength) is determined in accordance with the standard DIN 53504/ISO 37 on a standard S2 test specimen with a speed (traverse speed) of 200 mm per minute.

Without wishing to be tied to any one theory, the applicant believes that for a substantially similar hardness, a tensile strength as specified makes it possible to ensure an elasticity and dynamics similar to those of the Hytrel® conventionally used.

Specifically, during a makeup operation, the applicator member, and more particularly the application elements, undergo deformations both in compression and in elongation (especially by bending). The applicator member should therefore simultaneously have a certain hardness and a certain tensile strength and a resistance to bending.

In particular, the applicator member passes through a wiper and should oppose, to a certain extent, its application to the eyelashes or to the part of the body being made up.

Advantageously, the TPS material has a tensile strength less than or equal to 25 MPa. Such a maximum value makes it possible in particular to guarantee a certain application flexibility and the comfort of the user.

Preferentially, the TPS material has an elongation at break greater than or equal to 500%, preferably greater than or equal to 600%. This guarantees a good elasticity of the applicator member and/or of its application elements.

The elongation at break is measured according to the same method as the tensile strength.

Also preferentially, the TPS material has an elongation at break less than or equal to 800%, preferably less than or equal to 700%.

In an advantageously supplementary manner, the TPS material has a tear strength greater than or equal to 30 N/mm, or even greater than or equal to 60 N/mm.

The tear strength (tear resistance) is measured according to the standard ISO 34-1, method B (b) (Graves).

Preferably, the TPS is an SEBS.

Advantageously, the thermoplastic elastomer material has a hardness greater than or equal to 60 Shore A, preferably greater than or equal to 70 Shore A, or even greater than or equal to 85 Shore A. Such a hardness is particularly suitable for cosmetic product applicators.

Also advantageously, the thermoplastic elastomer material has a hardness less than or equal to 110 Shore A (equivalent to around 70 Shore D), preferably less than or equal to 100 Shore A (equivalent to around 60 Shore D).

In particular, for an applicator of mascara brush type and more generally a brush for integuments, a hardness between 80 and 100 Shore A, or even around 90-95 Shore A, will be chosen.

For applicators of lip or skin applicator type, a slightly softer material, having a hardness between 60 and 80 Shore A, preferably around 70 Shore A, will be chosen.

According to one particular embodiment, the TPS material contains at least 15% by weight of polyolefin filler, preferably at least 20%, or even at least 35%.

Depending on the case, it may be useful to add up to 45%, or even up to 50% or 55% by weight of polyolefin filler.

Preferably, the polyolefin filler comprises polyethylene, or even is constituted of polyethylene. In particular, the polyethylene could be a high-density (HD), low-density (LD), linear low-density (LLD) or radical low-density (RLD) polyethylene. Preferably, it is a high-density polyethylene.

Advantageously, the TPS material contains at most 70% by weight of polyolefin filler, preferentially less than 60% by weight.

According to one alternative or complementary embodiment, the TPS material comprises less than 20% by weight of mineral filler, preferably less than 15% or 10%, or even less than 1%, the mineral filler being selected from $CaCO_3$, aluminium and its compounds, kaolin, and zinc and its compounds (antibacterial properties in particular).

Without wishing to be tied to one theory, the applicant believes that a variation in the polyolefin, in particular polyethylene, organic filler, and/or the mineral filler, in particular $CaCO_3$, makes it possible to greatly influence the mechanical properties of the thermoplastic elastomer material.

The surface of the polyolefin particles, of organic and polymer nature, is wetted by the polymer within which they are used. There is consequently an interaction between the polyolefin filler particles and the polymer that generally results in a strengthening of the mechanical properties.

The mineral particles (preferably between 5 and 10 microns), in particular of $CaCO_3$, are easily dispersed homogeneously within the polymer matrix and are not wetted by the polymer. There is no interaction between the mineral filler and the polymer. Therefore, the calcium carbonate is generally used as filler for reducing the manufacturing costs and its use is generally considered to be advantageous.

The applicant believes that such a filler is in reality capable of negatively impacting the properties of the cosmetic applicator members, if need be, it appears that this impact can be at least partly compensated for or rebalanced by means of the polyolefin filler or the nature of the long or short segments of the TPS material.

The present application relates in particular to an applicator member according to the invention, characterized in that it comprises a core bearing a set of protruding application elements, extending mainly in a direction normal to the core, in particular in a radial direction. The core could advantageously have rotational symmetry, in particular a general cylindrical, or even frustoconical, shape. More specifically, the applicator member is a cosmetic brush, notably a mascara brush.

Preferentially, at least some, preferably all, of the application elements are made from the TPS material, preferably in one piece with the core, preferably from the same material.

The present invention will be better understood in light of the following detailed description with reference to the appended drawing in which.

Figure 1:
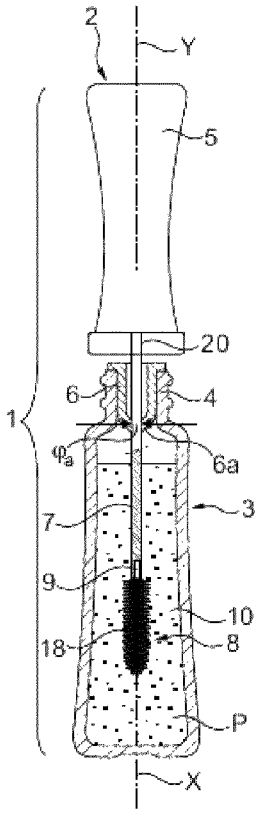
FIG. 1 is a schematic cross-sectional representation of an assembly for packaging and applying a cosmetic product comprising an applicator bearing an applicator member moulded from at least one thermoplastic elastomer material according to the present application.

FIG. 1 shows an assembly 1 for packaging and applying a cosmetic product, having an applicator 2 and an associated container 3 containing a product P to be applied to the eyelashes and/or eyebrows, for example mascara or a care product.

In a manner known per se, the container 3 has a threaded neck 4 and the applicator 2 has a closure cap 5 designed to be fixed on the neck 4 so as to close the container 3 in a sealed manner when it is not in use. The closure cap 5 also constitutes a gripping member for the applicator 2.

The latter has a stem 7 of longitudinal axis Y, which is attached at its upper end to the closure cap 5 and at its lower end to an applicator member 8. The latter has a core 10 bearing application elements 18, extending from the core 10 and all around this core. The application elements 18 are in the shape of spikes but other application element shapes can of course be envisaged.

Figure 2:
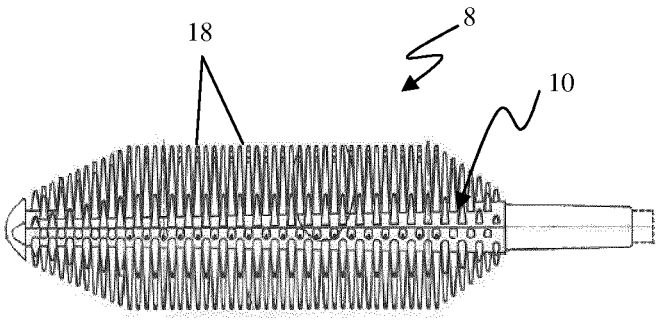
FIG. 2 is an enlarged schematic representation of a mascara brush serving as an applicator member in the assembly from FIG. 1.
Figure 3:
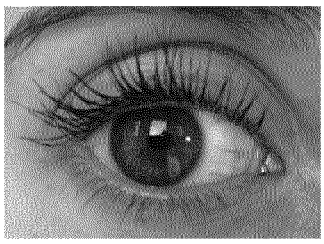
FIG. 3 shows photos of the makeup result for the applicator from FIG. 2 made from various materials.
Figure 3:
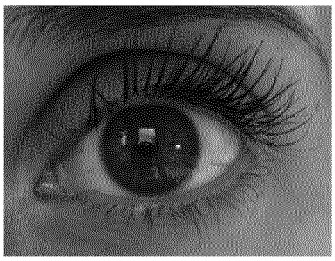
Figure 3:
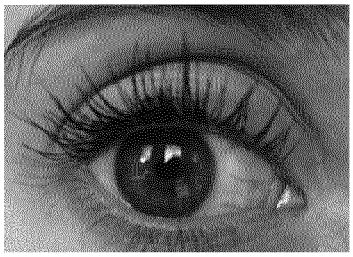
Figure 3:
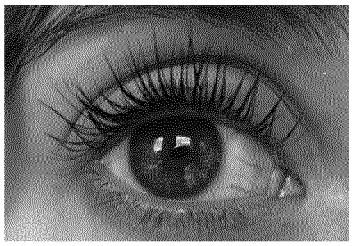
Figure 3:
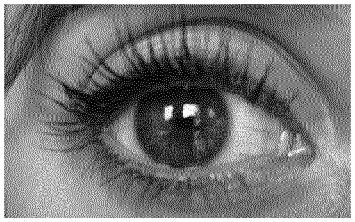
Figure 3:
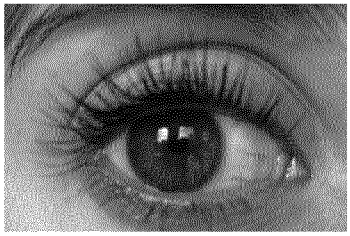

As can be seen in FIG. 2, the core 10 is of general cylindrical shape.

The container 3 also has a wiping member 6, inserted into the neck 4. This wiping member 6, which may be of any suitable type, has, in the example in question, a lip designed to wipe the stem 7 and the applicator member 8 when the applicator 2 is withdrawn from the container 3. The lip defines a wiping orifice **6*a* having a diameter adapted to that of the stem 7. The wiping member 6 may be made of elastomer. The wiping orifice 6*a*** has for example a circular shape.

As illustrated in FIG. 2, the applicator member 8 may have an end piece 9 for fixing it in a corresponding housing in the stem 7.

The applicator member 8 may be fixed in this housing in the stem 7 by any means, and notably by force-fitting, snap-fastening, adhesive bonding, welding, stapling or crimping.

With reference to FIG. 2, it can be seen that the core 10 has a shape that is elongate along a longitudinal axis X, which is rectilinear in the example described. The longitudinal axis X may be central, as illustrated.

In the example illustrated, the application elements 18 each extend from the core 10 along an elongation axis substantially perpendicular to the surface of the core 10, at the point at which the application element 18 is attached to the core 10.

In order to use the device 1, the user unscrews the closure cap 5 and withdraws the applicator member 8 from the container 3.

Once the applicator member 8 has passed through the wiping member 6, a particular quantity of product P remains between the spikes 18, in the grooves in the reinforcing webs 13, and between the rows, the spikes 18 not bending at their base on passing through the wiping member 6, creating reservoirs of product P along the entire length of the core 10 and on all sides, making it possible to load the eyelashes and/or eyebrows with product P in a satisfactory manner.

In accordance with the present application, the applicator member 8 is produced at least partially from a thermoplastic elastomer material from the TPS family, and in particular an SEBS.

More specifically, the applicator member 8 is produced by moulding, in particular according to an injection moulding process, known to a person skilled in the art and described for example in application. US 2015/0020332 A1.

Preferably, all or some of the application elements 18 are integrally moulded with the core 10. Alternatively, it is possible to overmould the application elements onto a central part that forms the core 10.

The thermoplastic elastomer material used has a tensile strength greater than or equal to 10 MPa, preferably greater than or equal to 15 MPa.

Preferentially, the TPS material has a tensile strength less than or equal to 25 MPa.

The TPS material may also have an elongation at break greater than or equal to 500%, preferably greater than or equal to 600%. The elongation at break will preferably be less than 800%, preferably less than 700%.

Additionally, the TPS material may have a tear strength greater than or equal to 30 N/mm, preferably greater than or equal to 60 N/mm.

The TPS material chosen for the production of the applicator member 8 (mascara brush) advantageously has a hardness between 70 and 110 Shore A, preferably between 85 and 100 Shore A, in particular around 90 or 95 Shore A.

The mechanical properties of the TPS material selected may be adjusted in various ways and in particular by the fillers.

Thus, the TPS material contains at least 15% by weight of polyolefin filler, preferably at least 20%, or even at least 35%, or else at least 45%, up to more than 55%, the polyolefin filler preferably comprising polyethylene, or even being constituted of polyethylene.

Preferably, the polyolefin, filler remains below 70% by weight, or even less than 60%.

As indicated previously, the applicant believes that inert mineral fillers, unlike polyolefin fillers, have a negative effect on the desired mechanical properties.

Thus, it is preferable for the TPS material selected to comprise less than 20% by weight of mineral filler, preferably less than 10%, or even less than 1%.

More particularly, the mineral filler could be selected from $CaCO_3$, aluminium and its compounds, kaolin, and zinc and its compounds. It could in particular be advantageous to select a mineral filler having additional properties, such as bactericidal properties.

Such materials are commercially available from many manufacturers, in particular from Kraiburg or Mitsubishi Chemical.

The table below gives in particular a list of references of available materials that may be suitable for the production of an applicator member 8 according to the present application. Table 1 also presents standard materials currently used and that are not completely satisfactory for the reasons expanded upon above. The latter are presented in italics.

TABLE 1

| Reference | | Hardness Sh A | % mineral filler | % PE filler | Tensile strength (MPa) | Elongation at break (%) | Tear strength (N/mm) |
|---|---|---|---|---|---|---|---|
| *Hytrel* | *Dupont* | *51 Sh D* | *0.4* | *0* | | | |
| *TOFI 823 90A W001* | *Mitsubishi* | *90* | *25* | *0 - minority amount* | *9.1* | *530* | *51 (angular)* |
| *TF9CGN* | *Kraiburg* | *88* | *25* | *0* | *5-5.5* | *400-450* | *30* |
| TF9 AAE | Kraiburg | 90 | 31 | 37.7 | 12 | 500 | 50 |
| TF9 AAB | Kraiburg | 95 | 0.2 | 49.8 | 22 | 650 | 66 |
| TM9 HET | Kraiburg | 108 | 0 | 59.8 | 18.5 | 750 | 73.5 |
| TF9AAA | Kraiburg | 83 | | | 18.5 | 700 | 30 |
| TF8 AAB | Kraiburg | 75 | 0 | 23 | 18.5 | 750 | 27 |
| TF8 THT | Kraiburg | 77 | 0 | 22.8 | 23.5 | 600 | 27 |
| *TF8CGN* | *Kraiburg* | *78* | | | *6-6.9* | *600-660* | *23* |
| *TOFI 823* | *Mitsubishi* | *70* | *20* | *0 -* | *5.4* | *540* | *29* |

TABLE 1-continued

| Reference | | Hardness Sh A | % mineral filler | % PE filler | Tensile strength (MPa) | Elongation at break (%) | Tear strength (N/mm) |
|---|---|---|---|---|---|---|---|
| *70A W001* | | | | minority amount | | | (*angular*) |
| TF7 THT | Kraiburg | 68 | 2 | 18.4 | 15 | 600 | 24.5 |
| HTF 884850 | Kraiburg | 53 Sh D (*147 ShA*) | 0 | 62.2 | | | |
| HTF 890531 | Kraiburg | 58 Sh D (*160 ShA*) | 20 | 64.2 | | | |

The applicator member 8 was moulded from several materials in order to test their performances in makeup terms.

The table below (Table 2) shows the result, evaluated by makeup sensory experts, after around 20 passes of the applicator member per eye with the same mascara formula.

TABLE 2

| Material | Makeup comparison |
|---|---|
| *Hytrel 51 Sh D* | Reference Hytrel<br>Non-prickly brush, slides, greater responsiveness than TOFI 823 90A. Slow loading, somewhat eyelash by eyelash even though some eyelashes are bonded to a point, not much loading. |
| *TOFI 823 90A W001* | Reference SEBS<br>Brush that lacks responsiveness, not prickly, slow loading but eyelash by eyelash deployment, softer than the reference Hytrel. |
| *TF9CGN* | Reference SEBS from another supplier<br>Soft brush very similar to TOFI 823 90A. |
| TM9HET | Impression of a stiff brush, no increase in deposition, it is applied and what is applied is then removed. Harder than the reference Hytrel. |
| HTF8848 | Very prickly and stiff brush, more so than TM9HET and than the Hytrel, it is stiffer. |
| TF9AAB | Makeup results very similar to the reference Hytrel with the feeling that the brush is softer even though the spikes prick a little |
| TF9AAE | Makeup results very similar to the reference Hytrel. Impression that the brush is slightly less prickly. |

The invention claimed is:

1. An application member for a cosmetic product applicator, for applying cosmetic product to keratin fibres, and for applying mascara to eyelashes, said applicator member being obtained at least partially by moulding at least one thermoplastic elastomer material, wherein said thermoplastic elastomer material is a thermoplastic styrene having a tensile strength greater than or equal to 10 MPa, wherein the thermoplastic styrene material contains at least 15% by weight of polyolefin filler, wherein the polyolefin filler comprises polyethylene, and wherein the thermoplastic styrene material comprises less than 20% by weight of a filler, the filler being selected from CaC03, aluminium and its mineral compounds, kaolin, and zinc and its mineral compounds.

2. The application member according to claim 1, wherein the thermoplastic styrene material has a tensile strength less than or equal to 25 MPa.

3. The application member according to claim 1, wherein the thermoplastic styrene material has an elongation at break greater than or equal to 500%.

4. The application member according to claim 1, wherein the thermoplastic styrene material has an elongation at break less than 800%.

5. The application member according to claim 1, wherein the thermoplastic styrene material has a tear strength greater than or equal to 30 N/mm.

6. The application member according to claim 1, wherein the thermoplastic styrene is an SEBS.

7. The application member according to claim 1, wherein the thermoplastic elastomer material has a hardness greater than or equal to 60 Shore A.

8. The application member according to claim 1, wherein the thermoplastic elastomer material has a hardness less than or equal to 110 Shore A.

9. The application member according to any claim 1, wherein the thermoplastic styrene material contains at least 35% by weight of the polyolefin filler.

10. The application member according to claim 9, wherein the thermoplastic styrene material contains at most 70% by weight of polyolefin filler.

11. The application member according to claim 1, wherein the thermoplastic styrene material comprises less than 10% by weight of the filler.

12. The application member according to claim 1, wherein the application member includes a core bearing a set of protruding application elements.

13. The application member according to claim 12, wherein at least some of the application elements are made from the thermoplastic styrene material, in one piece with the core.

14. The application member according to claim 1, wherein the thermoplastic styrene has a tensile strength greater than or equal to 15 MPa.

15. The application member according to claim 1, wherein the thermoplastic styrene material has an elongation at break greater than 600%.

16. The application member according to claim 1, wherein the thermoplastic styrene material has an elongation at break less than 700%.

17. The application member according to claim 1, wherein the thermoplastic styrene material has a tear strength greater than or equal to 60 N/mm.

18. The application member according to claim 1, wherein the thermoplastic elastomer material has a hardness greater than or equal to 85 Shore A.

19. The application member according to claim 1, wherein the thermoplastic elastomer material has a hardness less than or equal to 100 Shore A.

* * * * *